US006019083A

United States Patent [19]

Isogawa

[11] Patent Number: 6,019,083

[45] Date of Patent: Feb. 1, 2000

[54] THROTTLE AND SENSOR ARRANGEMENT FOR ENGINE

[75] Inventor: Atsushi Isogawa, Hamamatsu, Japan

[73] Assignee: Sanshin Kogyo Kabushiki Kaisha, Hamamatsu, Japan

[21] Appl. No.: 09/116,698

[22] Filed: Jul. 16, 1998

[30] Foreign Application Priority Data

Jul. 17, 1997 [JP] Japan ..... 9-207432

[51] Int. Cl.[7] ..... F02D 9/10

[52] U.S. Cl. ..... 123/336; 123/195 P; 123/400

[58] Field of Search ..... 123/195 C, 195 P, 123/336, 400, 579, 583; 73/116, 118.1

[56] References Cited

U.S. PATENT DOCUMENTS 4,864,996 9/1989 Hensel ..... 123/336 X 5,425,336 6/1995 Nakayama ..... 123/195 P X 5,803,044 9/1998 Kato ..... 123/336

*Primary Examiner*—Tony M. Argenbright

*Attorney, Agent, or Firm*—Knobbe, Martens, Olson & Bear LLP

[57] ABSTRACT

A throttle control system for an outboard motor and throttle position sensor therefor that permits a compact assembly by operating the throttle valve via an intermediate throttle valve operating shaft that is disposed closer to the body of the engine and farther from the protective cowling than the throttle valve. A throttle position sensor is associated with this intermediate throttle operating shaft for providing a signal indicative of throttle valve position for engine control.

9 Claims, 7 Drawing Sheets

THROTTLE AND SENSOR ARRANGEMENT FOR ENGINE

BACKGROUND OF THE INVENTION

This invention relates to a control for an internal combustion engine and more particularly to an improved throttle control and sensor arrangement for an engine.

Various types of control systems have been proposed for internal combustion engines. These control systems operate to provide electronic control for such things as the fuel supply system and/or ignition system for an engine in response to a wide variety of sensed engine parameters. By employing such systems, considerable improvements in engine performance, both in the terms of economy, emission control and also specific output can be achieved.

Generally in many engine applications, the positioning and location of these sensors presents no significant problem. The use of these controls is particularly advantageous in outboard motors. However, an outboard motor prevents some unique design problems, primarily because of the compact nature of the outboard motor and the minimum space availability.

In connection with outboard motors, the outboard motor includes a power head in which an internal combustion engine is mounted. The engine is surrounded a protective cowling so as to protect the engine and to give the overall construction a neat appearance. However, this arrangement must be kept quite compact and hence, the available space for the engine, its accessories and sensors is quite limited.

In connection with larger outboard motors, there are frequently provided a plurality of cylinders and many times these cylinders are each provided with their own throttle controls. This requires a linkage system for interconnecting the throttles so they operate in synchronism.

One of the types of sensors employed in most engine management systems is a throttle position sensor. Normally, these sensors are positioned on one end of the throttle valve shaft or where multiple throttle valve shafts on one end of one of the throttle valve shafts.

Due to the space constraints in an outboard motor, however, and the fact that the throttle linkage is quite frequently positioned in proximity to the protective cowling, such locations for the throttle position sensors are not totally practical. This is particularly true where multiple throttles are employed and an interconnecting throttle synchronizing linkage is embodied.

It is, therefore, a principle object of this invention to provide an improved throttle position sensor for an outboard motor.

It is a further object of this invention to provide an improved and compact throttle control and sensor arrangement for outboard motors.

SUMMARY OF THE INVENTION

This invention is adapted to be embodied in a throttle control and sensor arrangement for an outboard motor, having an internal combustion engine contained within the surrounding protective cowling. The engine has an induction system that includes a throttle body having at least one throttle valve supported therein on a throttle valve shaft. The end of the throttle valve shaft is positioned so that it is in proximity to the protective cowling. A linkage arrangement connects the throttle valve shaft with a remote throttle operator for positioning the throttle valve. This linkage arrangement includes an intermediate shaft that is mounted on the engine and which is positioned at a greater distance from the protective cowling than the throttle valve shaft. A throttle position sensor is mounted on the end of this intermediate shaft for providing a signal indicative of throttle valve position.

DETAILED DESCRIPTION OF THE PREFERRED EMBODIMENT

Figure 1:
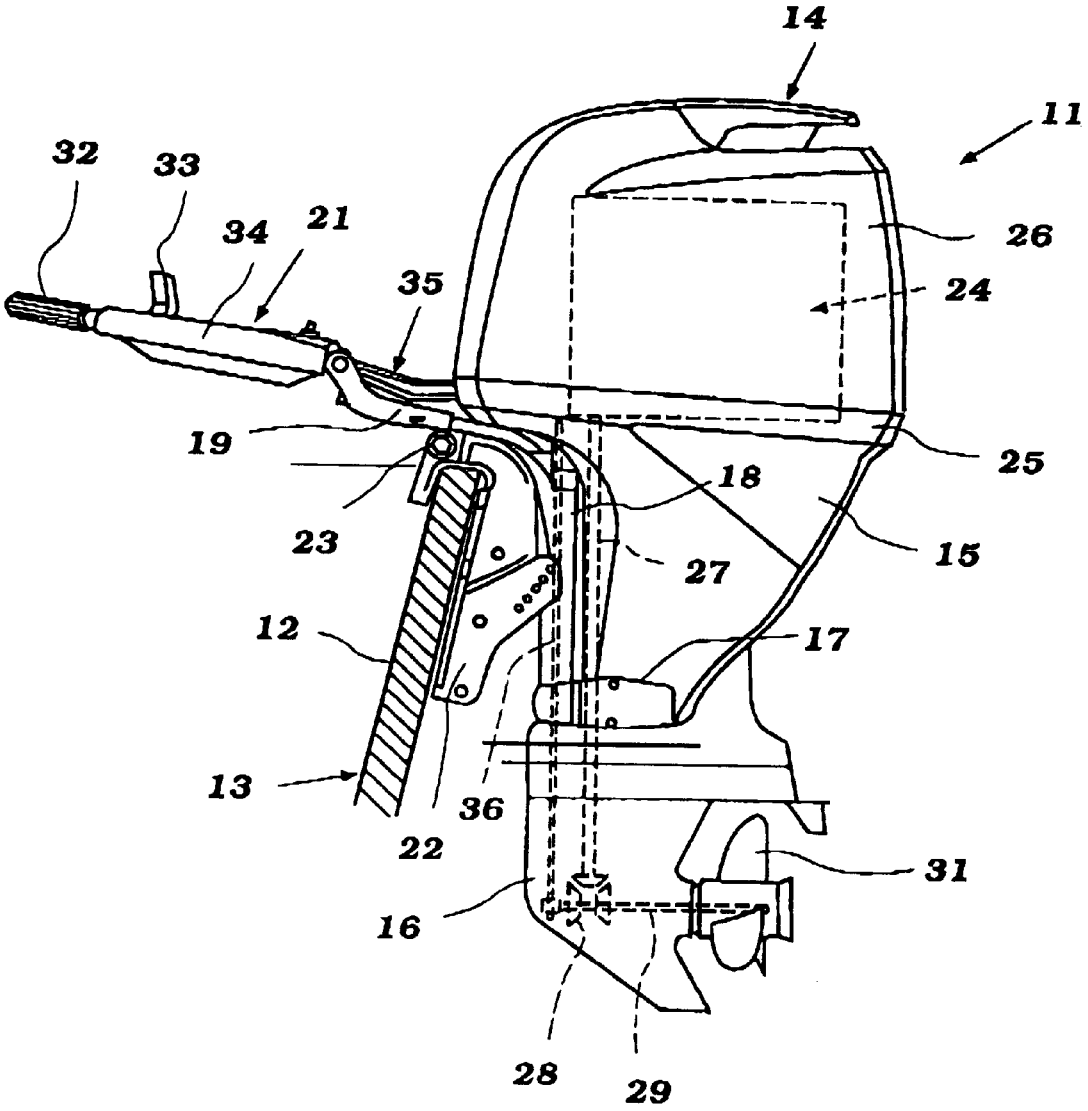
FIG. 1 is a side elevational view of an outboard motor constructed in accordance with an embodiment of the invention, shown attached to the transom of an associated watercraft, which is shown partially and in cross-section.

Referring now in detail to the drawings and initially to FIG. 1, an outboard motor constructed in accordance with an embodiment of the invention is identified generally by the reference numeral 11. The outboard motor 11 is shown attached to a transom 12 of an associated watercraft which is shown partially in cross-section and which is identified generally by the reference numeral 13.

The outboard motor 11 is comprised of a power head, indicated generally by the reference numeral 14, a drive shaft housing 15, and a lower unit 16. The drive shaft housing 16 has affixed to it a steering shaft, which does not appear in the drawings, but which is attached by means that include a lower mounting bracket 17. This steering shaft is journaled for rotation about a generally vertically extending steering axis within a swivel bracket 18. A tiller 19 is affixed to the upper end of the steering shaft and is connected, in turn, to a tiller control handle 21.

The swivel bracket 18 is pivotally connected to a clamping bracket 22 by means of a pivot pin 23. Pivotal movement of the swivel bracket 18 relative to the clamping bracket 22 about the pivot pin 23 permits tilt and trim adjustment of the outboard motor 11, as is well known in the art.

The power head 14 is comprised of a powering internal combustion engine, which is indicated in FIG. 1 in phantom and identified by the reference numeral 24. The construction of this engine 24 will be described in more detail later by reference to the remaining figures.

The engine 24 is enclosed within a protective cowling which is comprised of a lower tray number 25 and an upper, main cowling member 26 that is detachably connected to the tray 25 in any known manner.

As is typical with outboard motor practice, the engine 24 is positioned in the power head 14 so that its crankshaft, to be described later, rotates about a vertically extending axis. This is done so as to facilitate connection to a drive shaft 27 that is journaled appropriately in the drive shaft housing 15 and which extends into the lower unit 16.

In the lower unit 16, there is provided a conventional forward, neutral, reverse bevel gear transmission 28 which selectively drives a propeller shaft 29 in forward or reverse direction. A propeller 31 is affixed to this propeller shaft 29 and provides the propulsion for the watercraft 13.

The tiller control handle 21 has certain controls for the outboard motor 11. These include a twist grip throttle control 32 and a pivotally supported transmission control 33. These portions are mounted on a handle assembly 34. A bowden wire actuating mechanism, indicated generally by the reference numeral 35, connects the throttle control 32 and transmission control 33 to the respective components of the outboard motor, as will be described later. However, while still referring to FIG. 1, the shift control 33 operates a shift rod 36 which, in turn, operates the transmission 28 to effect its shifting between the various drive conditions, i.e. forward, neutral and reverse.

Figure 2:
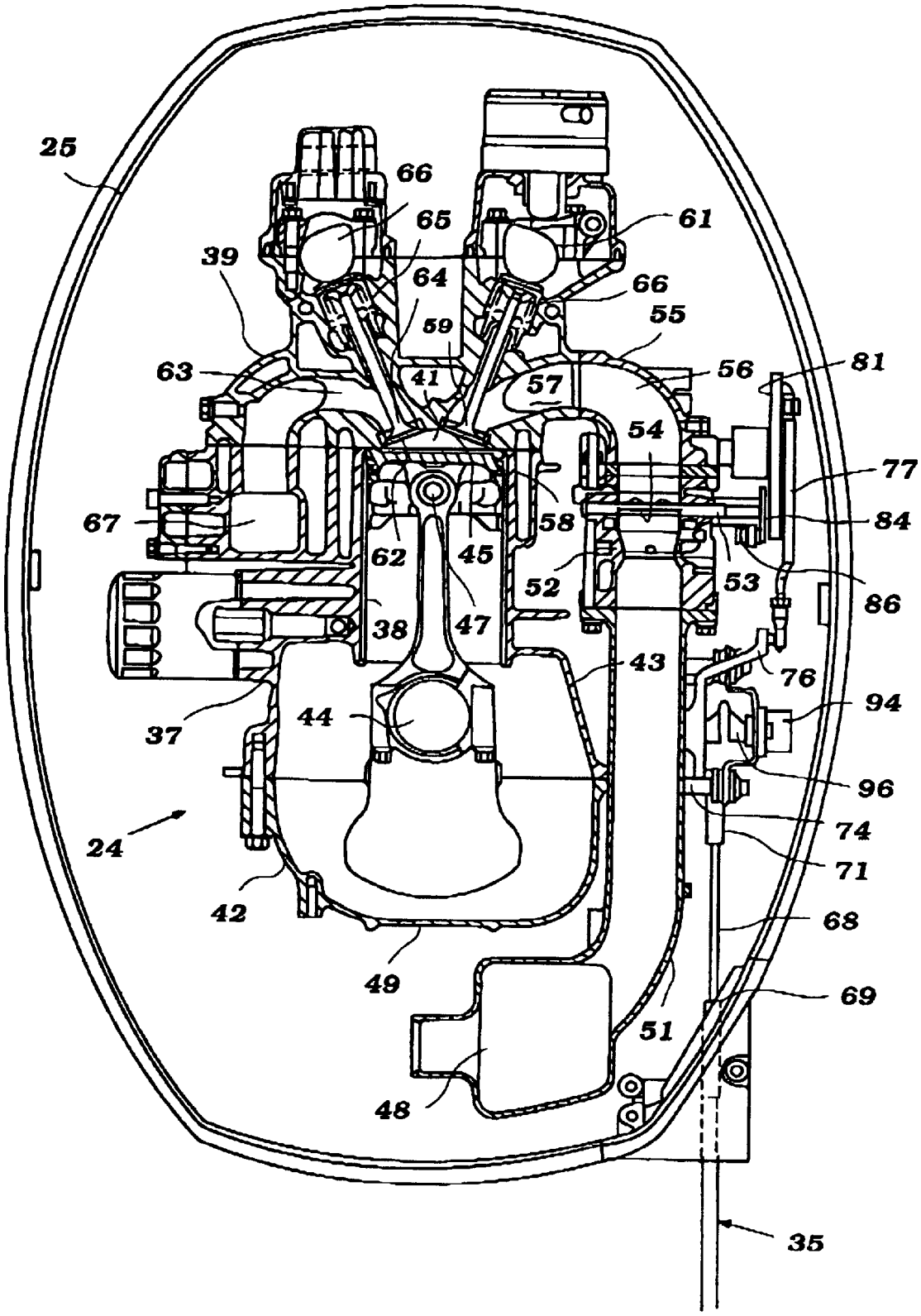
FIG. 2 is an enlarged top plan view of the power head of the outboard motor with the main cowling member removed and in cross-section through one of the cylinders.

Referring now in detail to the remaining figures, and initially primarily to FIGS. 2–4, the construction of the engine 24 will be described in more detail. In the illustrated embodiment, the engine 24 is depicted as being of the four cylinder in-line type. It will be readily apparent to those skilled in the art, however, that the invention can be utilized in conjunction with engines having other cylinder numbers and other cylinder configuration. Also, the invention can be utilized in conjunction with two cycle engines. However, the utility of the invention is particularly important in connection with four cycle engines because of the location of the throttle body and throttle valves of such engines, as will become apparent from the following description.

The engine 24 is comprised of a cylinder block 37 in which four aligned, vertically spaced, cylinder bores 38 are formed in a suitable manner. The axes of these cylinder bores 38 extend horizontally so as to orient the engine as required for outboard motor practice, as aforenoted.

A cylinder head assembly 39 is affixed to one end of the cylinder block 37 in a well known manner. This cylinder head 39 has individual recesses 41 that lie over each of the cylinder bores 38 and function to form a portion of the combustion chambers, as will become apparent.

A crankcase member 42 is affixed to the opposite end of the cylinder block 37 also in an appropriate manner. This crankcase member 42 with a skirt 43 of the cylinder block 37 forms a crankcase chamber in which a crankshaft 44 is rotatably journaled in any known manner. The crankshaft 44, as already noted, rotates about a vertically extending axis.

Pistons 45 are supported for reciprocation in each of the cylinder bores 38. These pistons 45 are connected by means of piston pins 46 to connecting rods 47. The other ends of the connecting rods 47 are journaled on the throws of the crankshaft 44 in a known manner for driving the crankshaft.

An induction system is provided for supplying an air charge to the combustion chambers formed by the cylinder head recesses 41, the heads of the pistons 45 and the cylinder bores 38. This induction system includes an elongated air inlet device and plenum chamber, indicated by the reference numeral 48, and which is positioned in spaced relationship to the forward end wall 49 of the crankcase member 42. An air silencer (not shown) may be associated with the inlet device 48 for drawing air from within the protective cowling to the inlet device 48.

The main cowling member 26 is formed with a suitable atmospheric air inlet so as to admit atmospheric air into the interior of the protective cowling.

The plenum chamber device 49 may be considered to be part of an intake manifold which has individual runners 51, each of which extends to a respective throttle body 52, which is disposed on one side of the engine and in space relationship to the cylinder block 37. The throttle bodies 52 journal throttle valve shafts 53, each of which carry a flow controlling throttle valve 54 for controlling the air flow through the induction system.

The throttle bodies 52 communicate at their downstream ends with a manifold 55 having a passage 56 that communicates with a cylinder head intake passage 57. These cylinder head intake passages 57 terminate at intake valve seats 58 formed in the cylinder head recess 41.

Poppet type intake valves 59 are mounted in the cylinder head assembly 39 and cooperate with these valve seats 58 to control the flow therethrough. Coil compression spring assemblies 60 cooperate with the valves 59 for holding them in their closed position. An intake camshaft 61 is journaled in the cylinder head assembly 56 for opening the intake valves 59. This intake camshaft 61 is driven from the crankshaft 44 at one half crankshaft speed through a suitable timing mechanism, in a manner well known in this art.

In addition to the fuel supplied to the combustion chamber 41 by the air induction system, there is also supplied fuel by means of some form of charge former. This may either comprise employing either an addition to the throttle bodies 52 or in combination with them a carburetor for each cylinder. Alternatively, fuel injection systems can be employed that inject fuel either into the manifold section 55, directly into the cylinder head intake passages 57 or direct cylinder injection. Since the invention deals primarily with the throttle control mechanism, the actual charge former employed has not been illustrated. Those skilled in the art will readily understand how the invention can be practiced with various types of charge forming systems.

The charge that is formed in the combustion chambers 41 in any of the aforedescribed manner is then fired by a spark plug (not shown). The spark plugs are mounted in the cylinder head assembly 39 and have their gaps protruding into the respective combustion chamber recesses 41 for firing the charge therein.

The charge which has burned in the combustion chambers 41 is then discharged through an exhaust system. This exhaust system includes an exhaust valve seat 62 formed in each cylinder head recess 41 which communicates with an cylinder head exhaust passage 63. A poppet type exhaust valve 64 controls the opening and closing of each exhaust valve seat 62.

This poppet type exhaust valve 64 is urged to its closed position by a coil compression spring assembly 65. An exhaust camshaft 66 is rotatably journaled in the cylinder head 39 in an appropriate manner for opening the exhaust valves 64. The exhaust camshaft 66, like the intake camshaft 61, are driven at one half crankshaft speed by a suitable timing drive.

The cylinder head exhaust passage 63 has a re-entrant section that communicates with an exhaust collector section and exhaust manifold 67 formed in the cylinder block 37. This exhaust manifold 67 delivers the exhaust gases downwardly to a conventional type of exhaust system provided in the drive shaft housing 15 and lower unit 16.

As is typical in the marine art, this exhaust system may include a high speed underwater exhaust gas discharge and an above the water low speed idle discharge. Such systems are well known in the art and, for that reason, further description of the exhaust system is not believed to be necessary to permit those skilled in the art to practice the invention. Resort may be had to any conventional structure with which to utilize the invention of this application.

As a general principle, the construction of the outboard motor 11 as thus far described may be considered to be conventional. The invention in this application deals with the mechanism by which the throttle valves 54 and their throttle valve shafts 53 are operated and how a throttle position sensor is employed in conjunction with this throttle linkage system. This system will now be described by primary reference to FIGS. 2–7.

As has been noted, the twist grip throttle control 32 operates a wire actuator mechanism 35. This mechanism 35 includes a throttle control wire actuator 68 that is contained within a protective sheath 69 which is clamped or suitably fixed to the tray 25 of the protective cowling of the power head 14.

Figure 3:
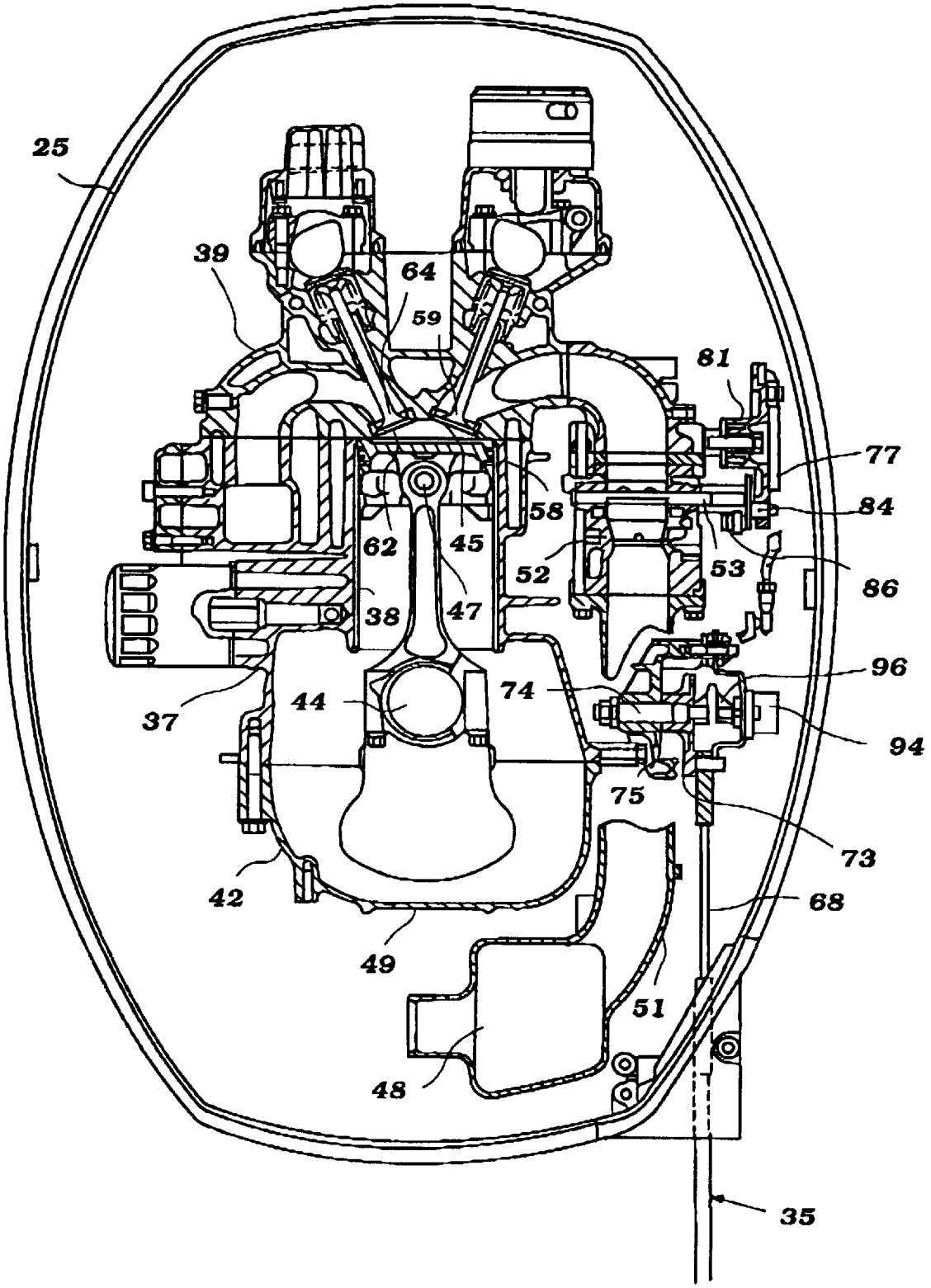
FIG. 3 is a view, in part similar to FIG. 2, but showing a portion of the intake manifold broken away so as to more clearly reveal a portion of the throttle linkage which appears below it.
Figure 4:
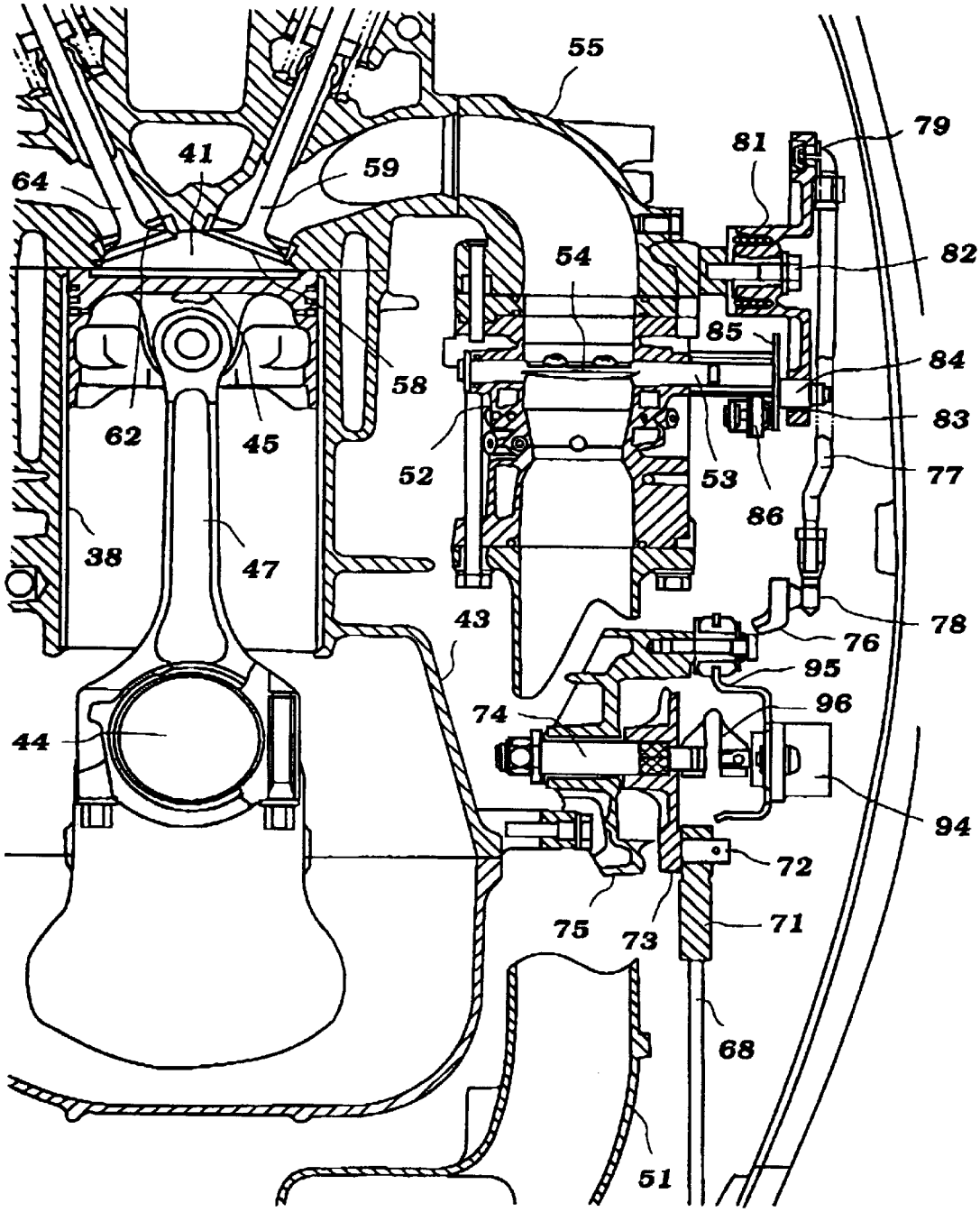
FIG. 4 is a further enlarged view, in part similar to FIG. 3, and shows the throttle linkage and throttle position sensor in more detail.

This wire actuator 68 is connected by means of a ferrule 71 to a pin 72 carried on an intermediate shaft lever arm 73 that is best shown in FIGS. 3 and 4, although it appears in additional figures. This intermediate lever arm 73 is fixed for rotation on an intermediate throttle control shaft 74 which is, in turn, journalled relative to the engine body and specifically the skirt 43 of the cylinder block 37 by means of a mounting bracket assembly 75.

Figure 5:
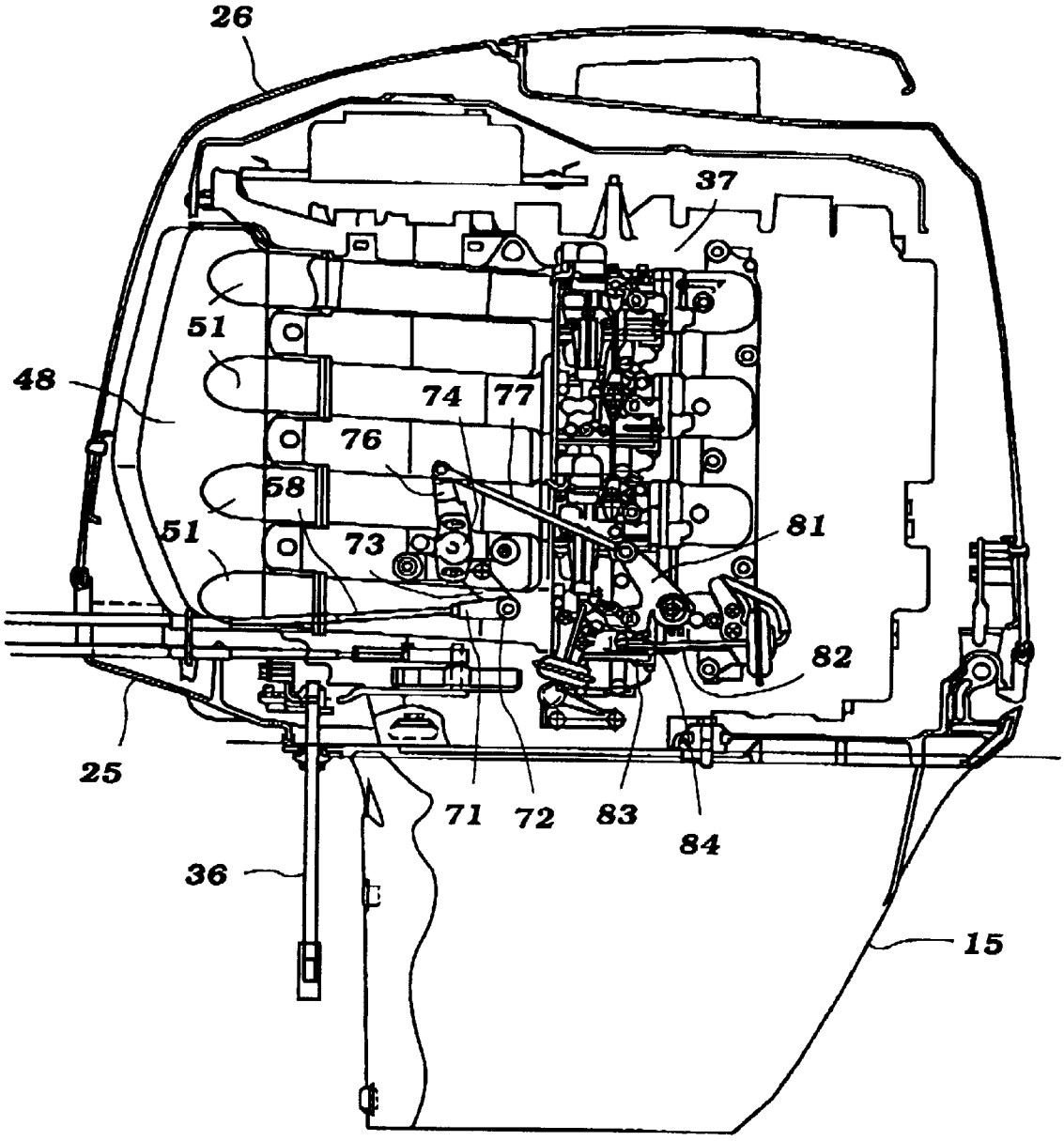
FIG. 5 is a side elevational view, looking in the same direction as FIG. 1, with portions of the protective cowling broken away and shown in section and illustrating the engine in the idle condition.
Figure 6:
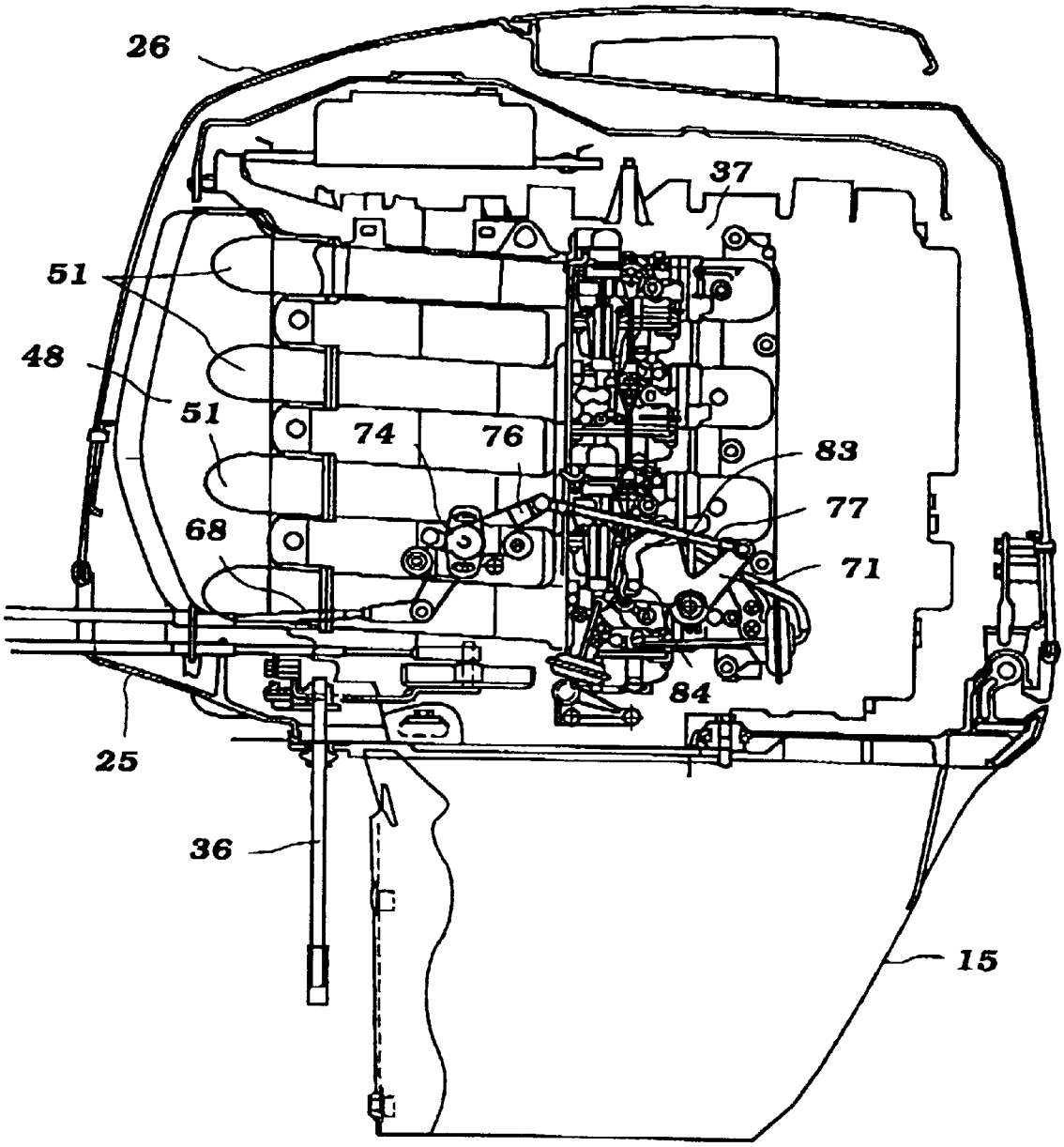
FIG. 6 is a view, in part similar to FIG. 5, but shows the throttle mechanism in its fully open or full throttle position.

A further lever arm 76 is affixed for rotation with the lever arm 73 as best seen in FIGS. 5 and 6. This further lever arm 76 is connected to a throttle control link 77 by means of a spherical connection 78. The throttle control link 77 is connected by a pivot joint 79 at its opposite end to a throttle actuating lever 81. The throttle actuating lever 81 is journaled on one of the intake manifold sections 55 and in the illustrated embodiment, this is the one associated with the lowermost throttle body 52. A pivot pin 82 is provided for this purpose.

The throttle actuating lever 81 is provided with a cam-shaped slot 83 in which a throttle pin 84 is received. The throttle pin 84 is carried by a throttle lever 85 that is affixed to the throttle valve shaft 53 of the lowermost throttle body 52 by means of an adjustable coupling 86.

The operation of this lowermost throttle valve shaft 53 and its associated throttle valve 54 may be understood by reference to FIGS. 5 and 6. FIG. 5 shows the mechanism in an idle position. In this position, the shape of the slot 83 is such that an adjustment may be made in the idle position of the throttle valve 54 without affecting the linkage system. That is, the slot 83 has a curved portion in the idle range that permits adjustments to be made without causing movement of the linkage system just described.

When the operator twists the throttle grip 32, the wire actuator 68 will be drawn to the left and this will cause the throttle control links 73 and 76 to rotate about the pivotal support for the intermediate throttle control shaft 74. This places a compressive force on the link 77 which causes the throttle control lever 81 to rotate in a clockwise direction to the position shown in FIG. 6. During this rotation, the cam slot 83 will act on the throttle pin 84 and rotate the throttle valve 54 and its associated throttle valve shaft 53 toward their fully opened positions.

Figure 7:
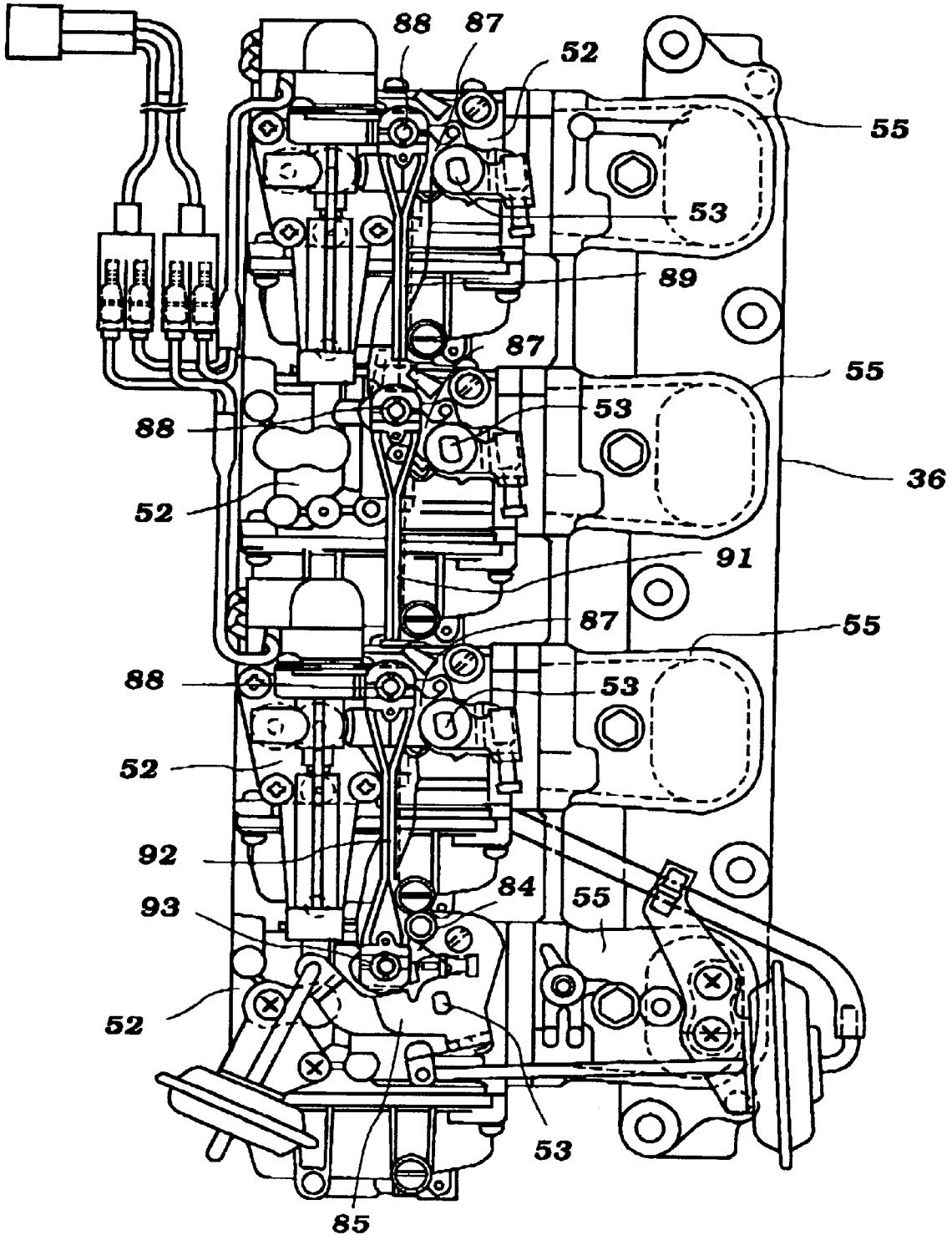
FIG. 7 is an enlarged view looking in the same direction as FIGS. 5 and 6, but with the throttle linkage removed so as to show the synchronizing mechanism between the individual throttle body.

The mechanism by which the throttle valves of the remaining throttle bodies 52 are operated will now be described by reference to FIG. 7. As may be seen in FIG. 7, the throttle valve shafts 53 of the remaining throttle bodies 52 all carry synchronizing levers 87. Each of these synchronizing levers 87 is affixed to the respective throttle valve shaft 53 and carries a coupling pin 88. The coupling pins 88 of the top three throttle bodies 52 are connected together respectively by synchronizing links 89 and 91.

The throttle link 87 of the second throttle body is connected to the directly actuated throttle lever 85 of the lowermost throttle body 52 by means of a further synchronizing link 92. This synchronizing link 92 is connected to a further synchronizing pin 93 that is carried on the throttle lever 85 of the lowermost throttle body. As a result, all of the throttle valves will be operated in synchronism. By adjusting the position of the levers 87 relative to the throttle shafts 53, synchronization between the individual throttle valve positions can be accomplished.

Referring again primarily to FIG. 4, it will be seen that the throttle valve shafts 53 and their exposed ends are positioned quite close to the protective cowling and specifically the main cowling member 26. This makes it difficult, if not impossible, to position a throttle position sensor directly on the throttle valve shaft 53 or any one of them. This is one reason why the intermediate throttle actuating shaft 74 is provided.

As may be best seen in this figure, this shaft 74 is positioned so that it does not extend outwardly beyond the throttle bodies 52. This permits the mounting of a throttle position sensing potentiometer 94 on the mounting bracket 75 by means of a mounting assembly 95. The shaft of the potentiometer 94 is connected to the intermediate throttle valve shaft 74 by a connector 96 so as to provide a signal indicative of the rotational position of the throttle valves 54 of the various throttle bodies 52. Thus, in this way, it is possible to position a throttle position sensor in the very close confines of the protective cowling and still have it operate without interference with the other components or the protective cowling.

Of course, the foregoing description is that of a preferred embodiment of the invention and various changes and modifications may be made without departing from the spirit and scope of the invention, as defined by the appended claims.

I claim:

1. A throttle control and sensor arrangement for an outboard motor having an internal combustion engine contained within a surrounding protective cowling, said engine having an induction system including a throttle body having at least one throttle valve supported therein on a throttle valve shaft, said throttle valve shalt being positioned in close proximity to said protective cowling, an intermediate throttle valve actuating shaft mounted on said engine in a position spaced inwardly from said protective cowling, a linkage system interconnecting said intermediate throttle valve actuating shaft with said throttle valve shaft for operating said throttle valve shaft from said intermediate throttle valve actuating shaft, and a throttle position sensor associated with said intermediate throttle valve shaft for providing a signal indicative of the position of the throttle valve.

2. A throttle control and sensor arrangement for an outboard motor as set forth in claim 1, wherein the engine has a cylinder block and the throttle body lies on one side of the cylinder block and wherein the intermediate throttle valve actuating shaft is mounted on the cylinder block in a position that is spaced no further from the cylinder block than the throttle body.

3. A throttle control and sensor arrangement for an outboard motor as set forth in claim 1, wherein the engine is provided with a plurality of vertically spaced throttle bodies and wherein the linkage system connects the intermediate throttle control shaft with the throttle valve shaft of only one of said throttle bodies, and further including synchronizing means connecting said throttle valve shaft of said only one throttle body with the throttle valve shafts of the remaining throttle bodies.

4. A throttle control and sensor arrangement for an outboard motor as set forth in claim 3 wherein the engine has a cylinder block and said one throttle body lies on one side of the cylinder block and wherein the intermediate throttle valve actuating shaft is mounted on the cylinder block in a position that is spaced no further from the cylinder block than said one throttle body.

5. A throttle control and sensor arrangement for an outboard motor as set forth in claim 4 wherein the engine has a plurality of cylinder bores one vertically above the other and there is a throttle body associated with each cylinder.

6. A throttle control and sensor arrangement for an outboard motor as set forth in claim 5 further including a crankcase member fixed to one end of the cylinder block and containing a crankshaft driven by pistons in the respective cylinder bores, and an induction system for delivering an air charge to the throttle bodies including an air inlet device positioned adjacent an end of the crankcase member that is spaced from the cylinder block.

7. A throttle control and sensor arrangement for an outboard motor as set forth in claim 6 wherein the synchronizing means is disposed closer to the throttle bodies than the connection of the linkage means to the one throttle valve shaft.

8. A throttle control and sensor arrangement for an outboard motor as set forth in claim 7 wherein the one throttle body is the throttle body associated with the lowest cylinder bore.

9. A throttle control and sensor arrangement for an outboard motor as set forth in claim 5 wherein the position sensor is connected to the intermediate throttle valve actuating shaft at a point spaced further from the cylinder block than the connection to the linkage means.

* * * * *